United States Patent [19]

Clarkson et al.

[11] Patent Number: 4,959,102

[45] Date of Patent: Sep. 25, 1990

[54] METHOD FOR MELTING AND REFINING COPPER METAL

[75] Inventors: James H. Clarkson; Kenneth R. Rhodes; Bruce E. Betterton, all of Carroll County; Richard B. Foster, Coweta County, all of Ga.

[73] Assignee: Southwire Company, Carrollton, Ga.

[21] Appl. No.: 320,427

[22] Filed: Mar. 8, 1989

[51] Int. Cl.[5] ..... C22B 15/14

[52] U.S. Cl. ..... 75/649; 75/653

[58] Field of Search ..... 75/63, 65, 72, 76, 649, 75/653; 266/900, 901; 431/10

[56] References Cited

U.S. PATENT DOCUMENTS

| | | | |
|---|---|---|---|
| 3,715,203 | 2/1973 | De Bie | 75/76 |
| 3,884,680 | 5/1975 | De Bie | 75/76 |
| 4,642,047 | 2/1987 | Gitman | 431/10 |

FOREIGN PATENT DOCUMENTS

| | | | |
|---|---|---|---|
| 582506 | 11/1946 | United Kingdom | 75/63 |

*Primary Examiner*—Melvyn J. Andrews

*Attorney, Agent, or Firm*—Stanley L. Tate; James W. Wallis, Jr.; George C. Myers, Jr.

[57] ABSTRACT

A method of melting and refining copper in the combustion chamber of a vertical shaft furnace which includes a step of superheating the melt so that slag formed by oxidized impurities can flow freely from the furnace.

12 Claims, 1 Drawing Sheet

METHOD FOR MELTING AND REFINING COPPER METAL

TECHNICAL FIELD

This invention relates to a process for preventing the accumulation of slag and impurities within the combustion chamber of a vertical shaft furnace used to melt copper and to the removal of certain elemental impurities from the molten copper melted therein. More specifically, the invention relates to a method of superheating a copper melt, as well as the slags which naturally occur in such a melting process, such that they remain fluid, and easily manageable and flow freely from the exit port of said shaft furnace; while simultaneously oxidizing and removing certain light metal and sulfur impurities from the molten copper.

BACKGROUND ART

When a charge of solid copper metal is heated and melted in a vertical shaft melting furnace, the charge melts from the bottom of the stack. The charge of metal within the furnace settles downwardly within the shaft and material is added to the top of the charge contained within the shaft. This process is continuous for as long as molten metal is needed. Slags form which are a natural result of this melting process. As the copper melts, the molten metal falls down onto the hearth of the shaft furnace, pools, and flows toward a low point in the hearth where a taphole or exit port is located. Prior art shaft furnaces provided air and gas fired burners which, when used to fire such a furnace, produced a metal on the hearth at only a slightly higher temperature than the melting point of the metal. This relatively cool metal, along with slag that forms in the chamber, have a tendency to freeze on the hearth or in the taphole. Slags, such as those described in the above system, have higher melting points than does the copper and are therefore more likely to freeze at or around the exit port. In the typical system, when this cool metal, and slags which have a relatively higher melting point, reach a cooler portion of the furnace, such as the taphole, they do not flow rapidly enough to keep the taphole free and flowing, and will often freeze up, thereby closing the taphole or exit port. When this frozen condition exists, the system must be shut down while a source of heat, such as an oxygen lance, is used to remelt the frozen mass and thereby open the taphole and restart the flow of metal from the furnace.

This situation is common place whether the burners used to fire the furnace are of a liquid fuel type, a gas and air postmix type, or an air and gas premix type of burner. These typical burners are only capable of melting copper from the bottom of the charge stack with the molten metal produced being only slightly above its melting temperature. An increase in the firing rate of these burners simply results in a greater flow of metal being melted from the bottom of the charge. However, the increased flow comprises metal still having the same relatively low temperature as that produced at the lower firing rate.

It is very common place for a shaft furnace to comprise a plurality of burners employed to heat and melt the charge of copper metal within the shaft furnace. The problem of the slag, causing the melt to refreeze before it can exit the furnace, is of major concern. In the manufacture of copper products, processes which prevent down times are essential. The melting and casting of copper metal cannot be interrupted to restart a frozen furnace if the process is to be efficiently carried out. When time must be taken from production of a product, in order to open a clogged furnace, production time and the related production expenses both go up.

It is therefore desirable that a method be devised whereby the molten copper and the related slags could be elevated to such a temperature that they will remain fluid, and easily manageable and flow freely from the hearth of the furnace thereby eliminating the down time necessary to remelt and allow these materials to flow from the system. It is to this end that the implementation of a burner capable of being fed gas, air, and oxygen comes into its own right. A burner being fed a controllable mixture of all three of these gases is typically designed such that its burning efficiency and temperature are precisely controllable. It is possible to achieve higher flame temperatures with such a burner than can be obtained with a burner combusting only air and fuel. U.S. Pat. No. 4,586,895 disclosed such a burner. The stated purpose of the design of this referenced burner is the elimination of slag from the mouth of the burner itself as the burner is used in applications of melting steel. After a given period of use, the oxygen/gas/air mixture is unbalanced such that an oxygen rich flame is produced. The oxygen rich portion of this flame, the oxygen being heated and applied at relatively high temperatures, results in the post oxidization and elevated temperatures of the slag accumulation at the mouth of the burner. The '895 patent teaches this oxidization of the slag, and the resulting high temperatures, causing the slag to become fluid so as to be easily removed from the burner throat by the natural action of the gases passing through said burner and flushing the slag away.

Another feature of the typical vertical shaft melting furnace deals with the quality of the metal used to charge said furnace. The composition of the metal which exits the shaft furnace is, with very small exception, identical to the composition of the metal used to charge the furnace. That is to say, there is no refining action associated with the use of a typical shaft furnace when used to melt copper. This feature of the vertical shaft melting furnace requires that a relatively high grade of feed material be used in the charge. The use of a higher grade material results in a correspondingly higher cost of operating the furnace. This is due to the cost of higher grade material being greater than the cost of lower grade material.

Many of the above enumerated draw backs can be overcome through the use of a gas, air, and oxygen burner.

DISCLOSURE OF THE INVENTION

Briefly described, the present invention addresses a method of preventing the accumulation of materials, such as partially solidified molten copper and/or copper slags, within the combustion chamber and at the taphole of a shaft type melting furnace. The burners normally used in such a furnace, being an air/gas mixture type burner, are replaced by burners such as the one described in the '895 patent. The '895 type burners are positioned such that slags formed in the melting process are heated by the oxygen rich flame to a temperature sufficiently high to allow their fluid exit from the furnace hearth. The process, in part, comprises superheating the droplets of copper and slag as they melt from the bottom of the copper charge. The process, also in part, comprises the introduction of free oxygen into the said melted droplets of copper as they melt from the bottom of the copper charge. This introduction of free oxygen, at the relatively higher temperature, results in the oxidation of certain light metal elements as well as the element sulfur. The oxidation of the light metal elements converts them into their respective oxides, thereby creating a relatively purer copper product than was previously charged. The oxidation of the sulfur contained within the charge material also acts as a refining step. The result of sulfur in molten copper, when said copper is cast, is a blister or bubble formed within the cast product. The present invention converts this free sulfur into a gaseous product which is liberated from the melt prior to solidification. The ability to oxidize light metal elements as well as sulfur is an unexpected benefit to the use of the air/oxygen/fuel type burner. Even though it was initially thought that the increased flame temperature would help to eleminate the build up of slag and molten metal from the bottom of the hearth, the added benefit of being able to maintain the elevated temperature of said materials coupled with the refining action of the oxygen rich flame were not expected. This is simultaneously accomplished with the high temperature, oxygen rich flame of an '895 type burner. This burner provides sufficient heat such that the droplets melted from the bottom of the copper charge have sufficient superheat to prevent their premature freezing on the hearth or in the taphole. The same is true for the slag product of the refining process.

Thus, it is an object of this invention to provide a method of preventing the accumulation of slag and frozen metal from and about the surface of the hearth of the combustion chamber, as well as at the taphole, of a copper melting shaft type furnace.

It is a further object of this invention to provide a method of refining certain impurities from the charge metal of a shaft type melting furnace and thereby increasing the quality of metal flowing from said furnace.

Another object of this invention is to provide a method of expediently removing slag from the hearth of the combustion chamber of a shaft type furnace without having to remove either burners or inspection plates from the furnace, with the process being capable of being performed continuously and as a routine part of the normal furnace operation.

Another object of this invention is to provide a convenient method of extending the operating cycle time of a copper melting shaft type furnace which does not require additional operating steps, such as the use of an oxygen lance.

A feature of this invention is the ability to control the temperature of, and the amount of free oxygen being applied to, the melting chamber of a shaft type melting furnace.

Another feature of the present invention is the ability to adjust the oxygen/fuel mixture such that an oxygen rich flame provides refining of certain undesirable elements from the copper charge being melted.

A further feature of the present invention is a method of operating a shaft furnace wherein all necessary apparatuses for preventing the build up of slag and frozen metal within the melting chamber and in and around the taphole are contained within the furnace itself, and used continuously, during the melting process.

An advantage of the present invention is the ability to maintain relatively elevated temperatures of both the molten copper as well as the slag impurities normally resulting from the melting process in a shaft type furnace, thereby decreasing their viscosity and decreasing the likelihood of their freezing within the furnace before they can flow out of said furnace and into a holding vessel.

Another advantage of the invention is the ability to strictly control the oxygen/fuel mixture such that precise temperatures and precise oxygen levels can be maintained.

Even another advantage of the present invention is the ability to remove certain impurities from the melt by using an oxidizing flame to oxidize said impurities prior to their introduction into the cast product being formed.

In accordance with these and other object, features, and advantages, there is provided an improved method for the melting of copper metal in a vertical shaft furnace which eliminates the likelihood of the metal and its associated slag products from freezing on the hearth of said furnace or in the taphole prior to their exiting the furnace. There is also provide a method whereby certain elemental impurities are continuously oxidized and removed from the melt. The method comprises the steps of providing a plurality of fuel/air/oxygen fed burners in a vertical shaft melting furnace; contacting the metal charge contained within such a furnace with the flame produced from the above reference burners; continuously exposing the metal charge to the relatively high temperature of said burner flames; maintaining a fuel/air/oxygen ratio to said burners which provides sufficient free oxygen to oxidize certain elemental impurities which are present; and continuously removing the superheated copper/slag mixture from the hearth of said furnace through a taphole.

These and other objects, features and advantages of the present invention will become readily apparent as the description proceeds with the following more particular description of the preferred embodiment of the present invention which is illustrated in the accompanying drawing.

BEST MODE OF CARRYING OUT THE INVENTION

Figure 1:
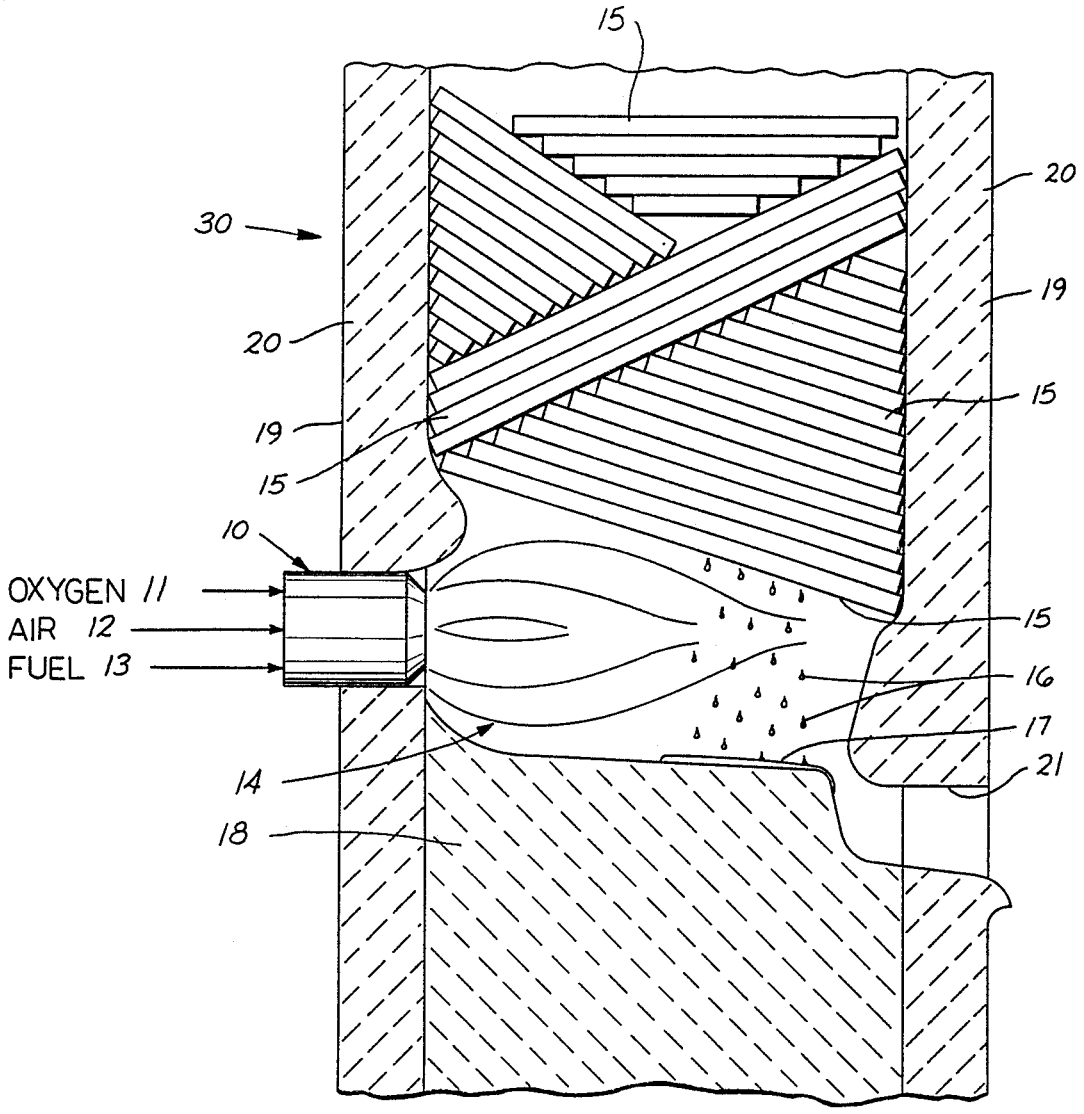
FIG. 1 is a cross-sectional view of a copper shaft melting furnace showing the relative positions of the major constituents.

FIG. 1 schematically depicts a typical vertical shaft melting furnace employing the present invention. A fuel/air/oxygen type burner 10 is mounted through the shell 19 and refractory lining 20 of a shaft type furnace 30. Controllable and variable sources of oxygen 11, air 12, and fuel 13 feed burner 10. Resulting flame 14 impinges on charge material 15 where said charge 15 begins to melt as droplets 16 of said charge 15 fall onto hearth 18 collecting as a pool of molten metal 17. Pool 17 then flows from hearth 18 through exit port or taphole 21.

Droplets of molten metal 16 are superheated by flame 14. This superheated condition results in pool 17 being of sufficiently high temperature so as not to freeze before exiting taphole 21. Oxygen source 13 is adjusted such that sufficient oxygen remains unburned whereby impurities contained within droplets 16 are oxidized. The oxides formed as droplets 16 are superheated and impurities therein are oxidized by flame 14 result in a refining action. The oxides so produced form slag and are removed after said slag and free metal leave furnace 30 through taphole 21.

It is this combination of superheating droplets 16 and the accompanying oxidation of impurities contained within droplets 16 that provide the benefits addressed by this invention.

What is claimed is:

1. A method of melting and refining copper, said copper containing impurities, in a shaft furnace comprising the steps of:

providing a source of oxygen;

providing a source of air;

providing a source of fuel;

transferring measured quantities of said oxygen, air and fuel, from their respective sources, to a combustion point;

burning said oxygen, air, and fuel at said combustion point under conditions that will produce an oxidizing flame and free oxygen;

directing said flame onto copper contained within the shaft furnace so that the metal melts to form a pool of molten copper; and refining said impure copper by oxidizing said impurities with said free oxygen.

2. The method of claim 1, including the additional step of superheating the pool of molten copper.

3. The method of claim 1, further including the step of forming oxides of impurities present in the copper, separating oxides from the molten copper as slag and as gaseous oxides which accumulate upon and along the molten pool; and flushing the gaseous oxides from the furnace.

4. The method of claim 2, additionally including the step of superheating said molten copper until its viscosity is reduced and it will flow freely from the furnace.

5. The method of claim 1, including the step of individually controlling the quantities of oxygen, air, and fuel that are burned.

6. The method of claim 1, with the additional step of oxidizing metallic impurities with said oxidizing flame.

7. The method of claim 6, with the additional step of separating the metal oxides from the pool of molten copper.

8. The method of claim 1, with the additional step of oxidizing light metal impurities with said oxidizing flame.

9. A method of melting and refining copper, said copper containing metallic and non-metallic elemental impurities, in a shaft furnace comprising the steps of: supply a source of solid impure copper metal; supplying oxygen, air, and fuel to burners of the melting chamber of said shaft furnace at a ratio and at volumes sufficient to form an oxygen rich flame containing free oxygen, said flame being used to melt impure solid copper charge material; oxidizing impurities contained within said molten copper with said free oxygen; and superheating said molten copper and said oxidized impurities such that they will flow freely from said shaft furnace.

10. The method of claim 9, with the additional step of supplying sufficient oxygen to the melting chamber of said shaft furnace, through said burners, so as to oxidize non-metallic impurities contained within said impure copper material.

11. The method of claim 9, with the additional step of superheating both copper and oxidized impurities to such temperature that they will flow freely from said furnace.

12. The method of claim 10, with the additional step of supplying sufficient free oxygen to the melting chamber of said furnace, through said burner, so as to oxidize the non-metallic impurity sulfur contained within said impure copper metal.

* * * * *